US007997859B2

(12) United States Patent
Li et al.

(10) Patent No.: US 7,997,859 B2
(45) Date of Patent: Aug. 16, 2011

(54) COOLING FAN

(75) Inventors: Ying-Liang Li, Shenzhen (CN); Pei-Su Zhu, Shenzhen (CN); Yueh-Feng Lin, Tu-Cheng (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 602 days.

(21) Appl. No.: 12/195,398

(22) Filed: Aug. 20, 2008

(65) Prior Publication Data

US 2009/0269194 A1 Oct. 29, 2009

(30) Foreign Application Priority Data

Apr. 28, 2008 (CN) ..... 2008 1 0066700

(51) Int. Cl.
*F03D 11/00* (2006.01)

(52) U.S. Cl. ..... 415/175; 415/211.2; 415/215.1

(58) Field of Classification Search ..... 415/93, 415/175, 211.2, 215.1
See application file for complete search history.

(56) References Cited

U.S. PATENT DOCUMENTS 4,391,564 A * 7/1983 Garkusha et al. ..... 415/126
6,206,635 B1 3/2001 Golm et al.
6,244,818 B1 6/2001 Chang
6,261,055 B1 * 7/2001 Owczarek ..... 415/148
6,328,529 B1 * 12/2001 Yamaguchi et al. ..... 415/178
6,386,276 B1 5/2002 Chen et al.
6,612,817 B2 9/2003 Lin et al.
6,663,342 B2 12/2003 Huang et al.
6,799,942 B1 10/2004 Tzeng et al.
6,899,521 B2 * 5/2005 Horng et al. ..... 415/208.2
6,910,862 B2 * 6/2005 Horng et al. ..... 415/211.2
7,014,420 B2 3/2006 Chang
7,018,175 B2 * 3/2006 Horng et al. ..... 415/211.2
7,184,268 B2 2/2007 Espinoza-Ibarra et al.
7,306,429 B2 * 12/2007 Horng et al. ..... 415/210.1
7,334,988 B2 * 2/2008 Horng et al. ..... 415/211.2
7,600,962 B2 * 10/2009 Mizumi et al. ..... 415/1

FOREIGN PATENT DOCUMENTS

CN 1932304 3/2007
FR 1346934 A 12/1963
JP 11-264396 A 9/1999

* cited by examiner

*Primary Examiner* — George Fourson, III
(74) *Attorney, Agent, or Firm* — Frank R. Niranjan

(57) ABSTRACT

A cooling fan includes a fan housing, a base, a rotor, a stator, and a fan guard. The fan housing forms an intake and an outlet at two opposite sides thereof, respectively. The base is arranged at the outlet of the fan housing. The stator is mounted on the base. The rotor is rotatably supported by the stator. A plurality of stationary blades extends from the base to the fan housing. The fan guard attaches to the outlet of the fan housing. A cylinder is arranged at a center of the fan guard and attaches to the base of the fan housing. A plurality of guard blades extend radially and outwardly from the cylinder. Each guard blade and the nearest stationary blade define a gap therebetween along a circumference of the cooling fan.

15 Claims, 9 Drawing Sheets

COOLING FAN

BACKGROUND

1. Field of the Invention

The present invention relates to a cooling fan, and more particularly to a cooling fan having improved stationary blades.

2. Description of Related Art

With continuing developments in electronic technology, electronic packages such as CPUs (central processing units) generate increasing amounts of heat that requires immediate dissipation. Cooling fans are commonly used in combination with heat sinks for cooling such CPUs.

Normally, a cooling fan includes a stator and a rotor. The rotor includes a hub and a magnet arranged in the hub and surrounding the stator, which includes a stator core with coils wound therearound. When electrical currents are supplied to the coils, the rotor is rotated by magnetic force of the coils and fan blades of the rotor produce forced airflow. A hollow frame supports the rotor and the stator thereon. A columnar supporting base is formed in a center of the frame, and a number of ribs interconnect the supporting base and the frame. Unfortunately, when airflow exits the frame, turbulent flow is generated after the airflow encounters the ribs, having an adverse effect on air flow and reducing operating efficiency of the fan.

For the foregoing reasons, therefore, there is a need in the art for a cooling fan which overcomes the described limitations.

SUMMARY

According to an exemplary embodiment of the present invention, a cooling fan includes a fan housing, a base, a rotor, a stator, and a fan guard. The fan housing forms an air intake and an outlet at two opposite sides thereof, respectively. The base is arranged at the outlet of the fan housing. The stator is mounted on the base. The rotor is rotatably supported by the stator. A plurality of stationary blades extends from the base to the fan housing. The fan guard attaches to the outlet of the fan housing. A cylinder is arranged at a center of the fan guard and attaches to the base of the fan housing. A plurality of guard blades extend radially and outwardly from the cylinder. Each guard blade, with the nearest stationary blade, defines a gap therebetween along a circumference of the cooling fan.

Other advantages and novel features of the present invention will be drawn from the following detailed description of the exemplary embodiments of the present invention with attached drawings.

DETAILED DESCRIPTION OF THE EMBODIMENTS

Figure 1:
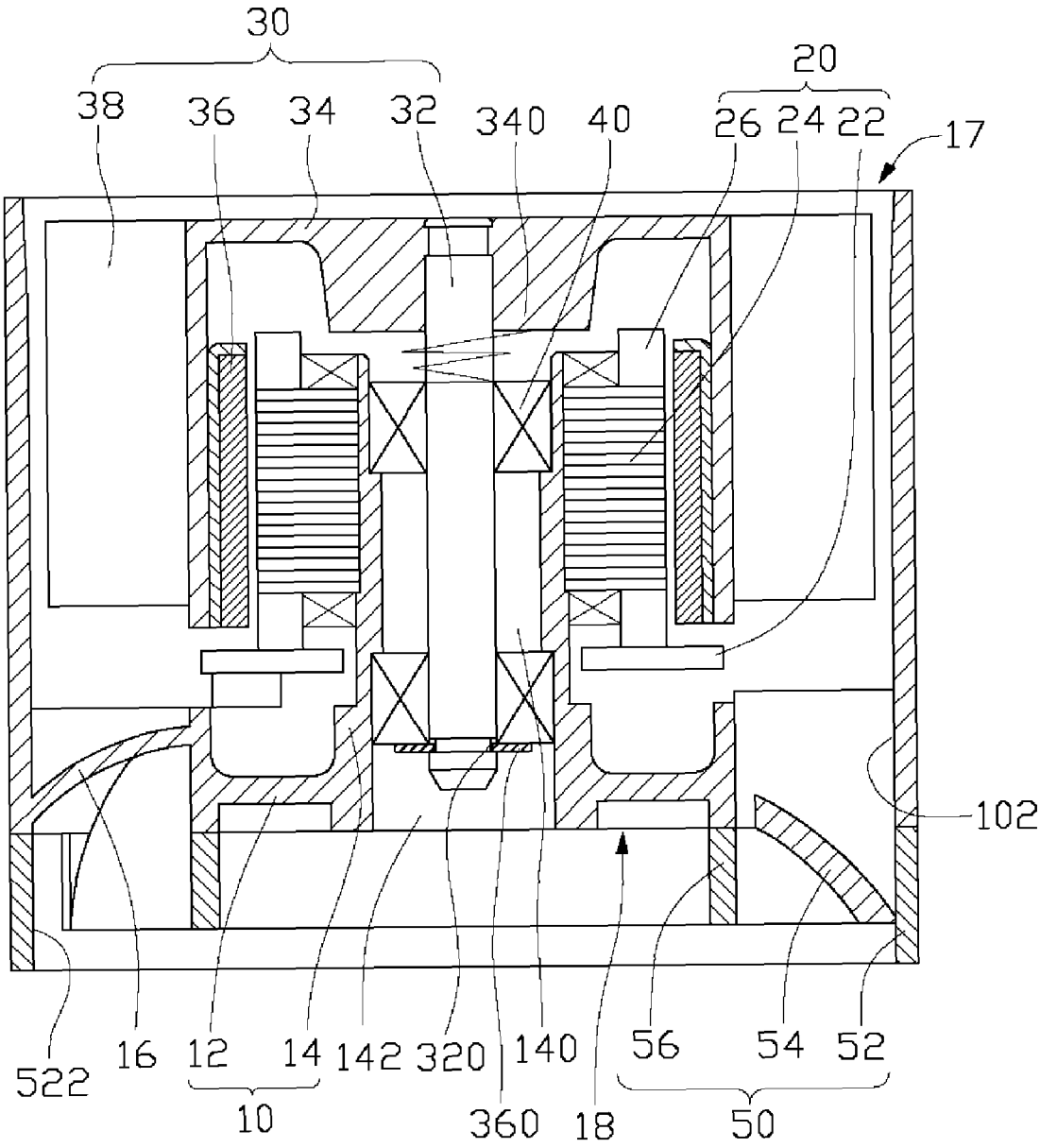
FIG. 1 is a cross section of a cooling fan according to an exemplary embodiment.
Figure 2:
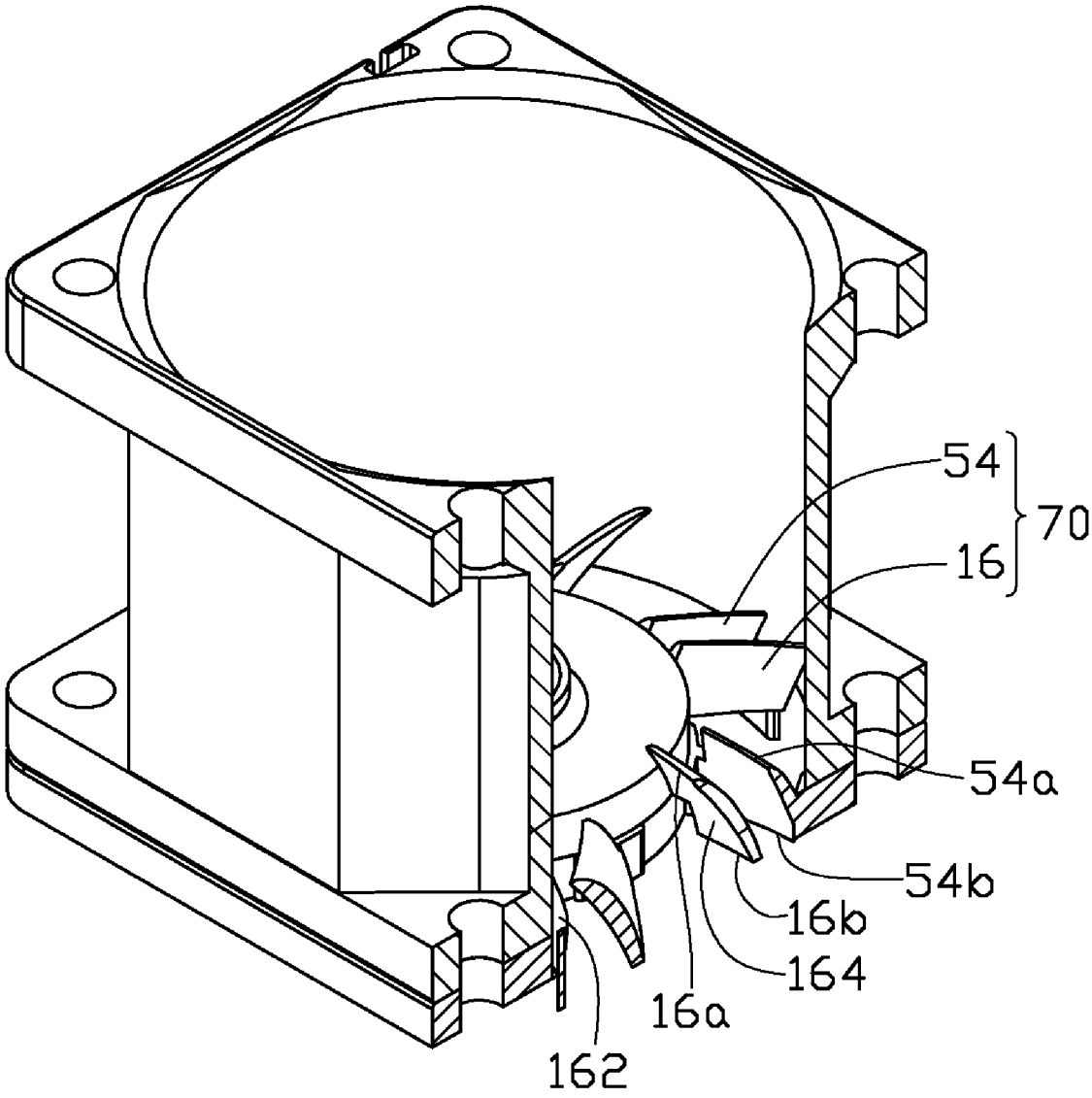
FIG. 2 is an isometric cross section of the cooling fan of FIG. 1 without rotor and stator, clearly showing guide units of the cooling fan.
Figure 3:
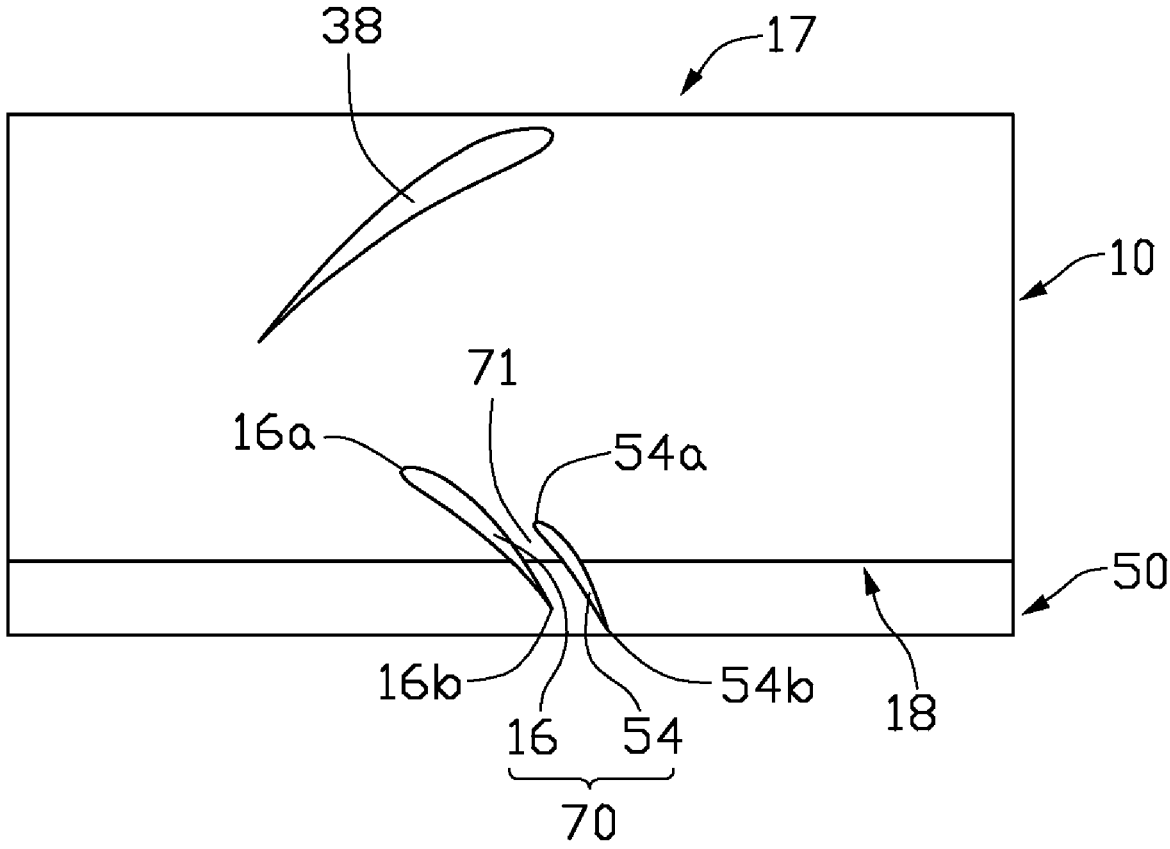
FIG. 3 shows the relationship between the rotary blades and guide units of the cooling fan of FIG. 1.

Referring to FIGS. 1-3, a cooling fan according to an exemplary embodiment includes a fan housing 10, a stator 20, a rotor 30, a pair of bearings 40, and a fan guard 50.

The fan housing 10 is square and hollow. An air intake 17 is formed at a top of the fan housing 10, and an outlet 18 is formed at a bottom of the fan housing 10 opposite to the air intake 17. A base 12 is received in the fan housing 10 and arranged at the outlet 18 thereof. The base 12 is substantially circular. A central tube 14 extends upwardly from a center of the base 12. A central hole 140 extends through the central tube 14, such that top and bottom ends of the central tube 14 are open. An annular recess 142 communicating with the central hole 140 is formed on an inner circumference of the top and bottom ends of the central tube 14, respectively. Each recess 142 has a diameter exceeding that of the central hole 140. Thus the top and bottom ends of the central tube 14 have an inner diameter exceeding that of the other portion of the central tube 14.

The stator 20 is mounted around the central tube 14 of the base 12. The stator 20 includes a stator core 24 with coils 26 wound thereon to establish an alternating magnetic field, and a PCB 22 (printed circuit board) electrically connected with the coils 26 to control electrical current flowing through the coils 26. The rotor 30 includes a hub 34 forming a shaft seat 340 at a central portion thereof, a plurality of rotary blades 38 extending radially and outwardly from an outer periphery of the hub 34, a magnet 36 adhered to an inner surface of the hub 34 and facing the coils 26 of the stator 20, and a shaft 32 extending downwardly from the shaft seat 340 of the rotor 30. The shaft 32 defines an annular notch 320 at a distal end thereof.

The ball bearings 40 are received in the top and bottom recesses 142 of the central tube 14, respectively, and surround the shaft 32. When assembled, the shaft 32 of the rotor 30 extends through the ball bearings 40, and thus is rotatably supported thereby. A locking ring 360 is arranged in the bottom recess 142 of the central tube 14 and engages the notch 320 of the shaft 32 to limit movement thereof along an axis thereof. A conical coil spring is arranged between the top ball bearing 40 and the hub 34 applying a preset engaging pressure therebetween, ensuring that the top ball bearing 40 remains stationary relative to the hub 34 in the axis of the shaft 32.

A plurality of stationary blades 16 extend radially and outwardly from the base 12 to an inner surface 102 of the fan housing 10. The stationary blades 16 are evenly spaced along a circumference of the base 12. The stationary blades 16 are angled in the direction of the forced airflow. Each stationary blade 16 is thin and curved, and includes a windward surface 162 facing the forced airflow and an opposite leeward surface 164. A top end **16*a* of each stationary blade 16 is higher than a top side of the base 12, and a bottom end 16*b* of each stationary blade 16 is lower than a bottom side of the base 12**.

The fan guard 50 attaches to the outlet 18 of the fan housing 10. The fan guard 50 includes a frame 52, a cylinder 56 at a center thereof, and a plurality of guard blades 54. The cylinder 56 is substantially the same size as the base 12, and is coaxial thereto. A top of the cylinder 56 abuts the bottom of the base 12 of the fan housing 10. The guard blades 54 are radially arranged inside the frame 52 and extend from an inner surface 522 of the frame 52 to an outer surface of the cylinder 56. The quantity of the guard blades 54 is the same as the stationary blades 16. Each guard blade 54 is similarly shaped to stationary blade 16, angled and thin with a windward side facing the forced airflow.

The guard blades 54 are evenly spaced along a circumference of the cylinder 56. Along the circumference of the base 12/cylinder 56, the guard blades 54 and the stationary blades 16 are alternating. Each guard blade 54 is adjacent to a neighboring stationary blade 16, away from the other neighboring stationary blade 16. Cooperatively the guard blade 54 and the corresponding adjacent stationary blade 16 form a guide unit 70. A narrow gap 71 along the circumference is defined between the guard blade 54 and the stationary blade 16 of each guide unit 70. The guard blade 54 of each guide unit 70 faces the windward surface 162 of the corresponding stationary blade 16. A top end 54*a* of the guard blade 54 is higher than the top of the cylinder 56, being higher than the bottom end 16*b* of the stationary blade 16. A bottom end 54*b* of the guard blade 54 is lower than a bottom side of the cylinder 56, and is approximately level with the bottom side of the fan guard 50. Thus the stationary blade 16 and the guard blade 54 of each guide unit 70 partly overlap along an axis of the fan.

During operation, the rotor 30 is rotated by the interaction of the alternating magnetic field established by the stator 20 and the magnetic field of the magnet 36 of the rotor 30. The rotary blades 38 thus produce forced airflow. As the stationary blades 16 are curved and thin, the forced airflow crosses the windward surfaces 162 of the stationary blades 16 to the outlet 18 of the fan housing 10. The windward sides of the guard blades 54 guide the forced airflow out the fan guard 50 from the outlet 18 to dissipate heat thereby. Turbulence from the related cooling fan generated by the airflow contacting the ribs is avoided. As the guide units 70 each include two separate parts, the stationary blade 16 and the guard blade 54, each part of the guide unit 70 can be shorter than that if each guide unit 70 includes only a single part. Thus, the cooling fan in accordance with the present invention can have a low profile. When the forced airflow leaves the fan housing 10 to the fan guard 50, the airflow is redistributed. A boundary layer formed at a bounding surface of the stationary blade 16 and the airflow or at a bounding surface of the guard blade 54 and the airflow is thin. Resistance to the airflow caused by the bounding surfaces is reduced, flow speed is increased, and separation between the forced airflow and the windward surfaces 162 of the stationary blades 16 is avoided. Turbulence can be avoided at the windward surfaces 162 of the stationary blades 16 near the outlet 18 of the fan housing 10 and at the windward surfaces 162 of the stationary blades 16 near an outlet of the fan guard 50. Efficiency of the cooling fan is improved accordingly.

Figure 4:
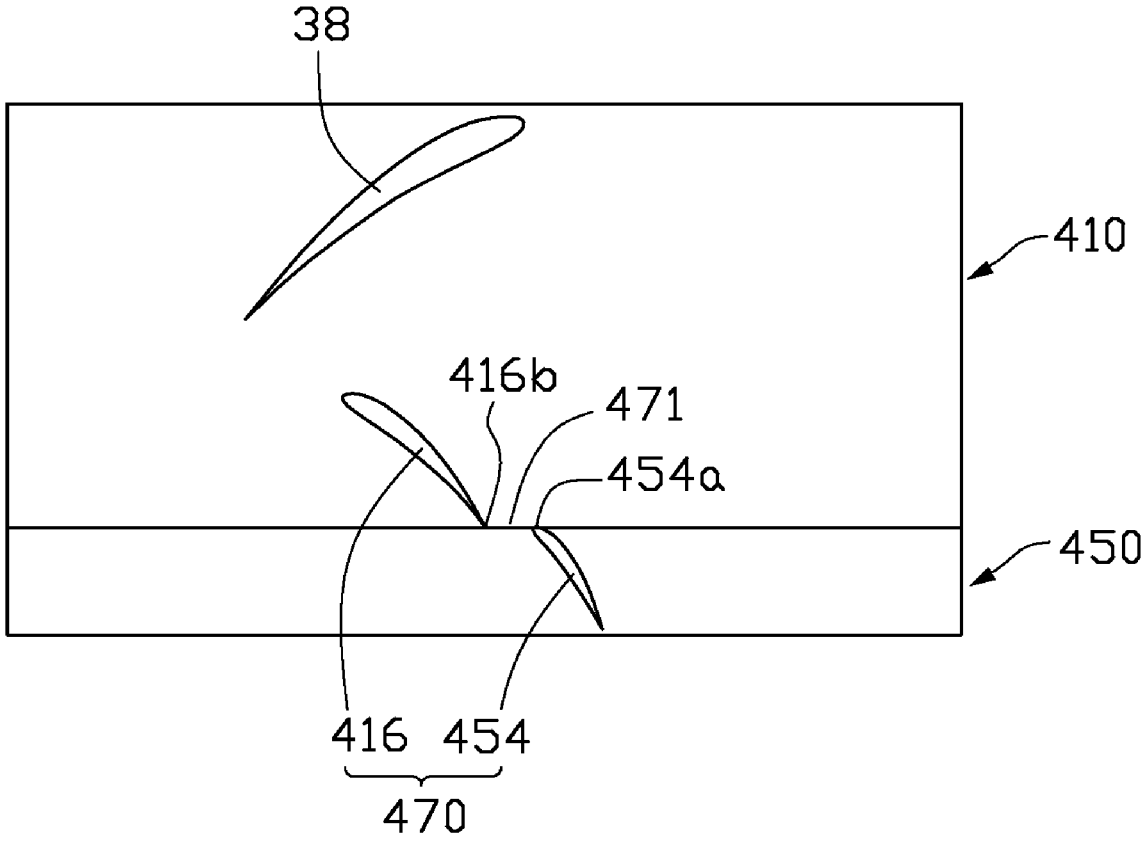
FIG. 4 shows the relationship between the rotary blades and the guide units according to an alternative embodiment.

FIG. 4 shows an alternative embodiment of the cooling fan. In this embodiment, the cooling fan has a plurality of stationary blades 416 formed in the fan housing 410, and a plurality of guard blades 454 formed in the fan guard 450. Each stationary blade 416 and a corresponding guard blade 454 form a guide unit 470. This embodiment differs from the first in that a bottom end 416*b* of the stationary blade 416 is approximately level with a bottom side of the fan housing 410, and a top end 454*a* of the guard blade 454 of the fan guard 450 is approximately level with the top side of the fan guard 450. A narrow gap 471 along the circumference of the cooling fan is defined between the bottom end 416*b* of the stationary blade 416 and the top end 454*a* of the guard blade 454 of each guide unit 70. In other words, the guard blade 416 and the stationary blade 454 of each guide unit 70 are spaced along an axis and the circumference of the cooling fan.

Figure 5:
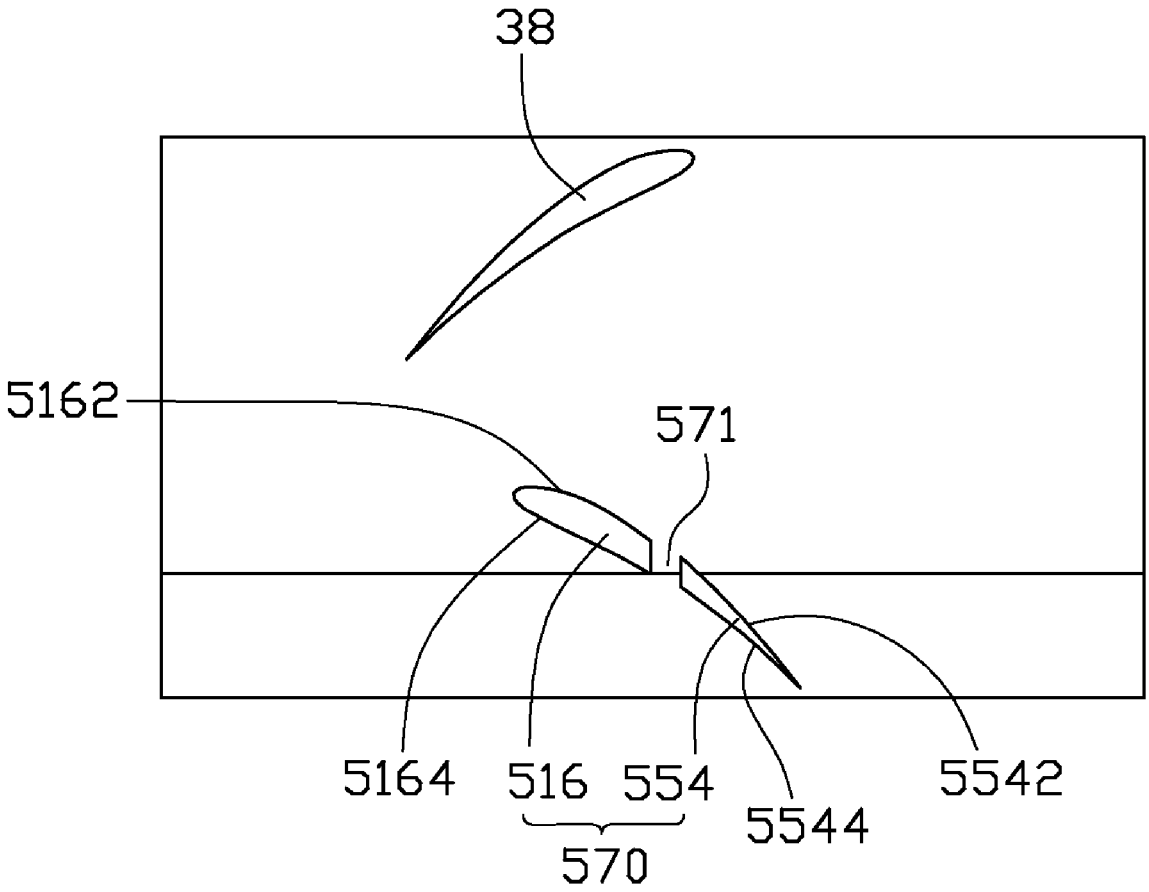
FIG. 5 shows the relationship between the rotary blades and the guide units according to a third embodiment.

FIG. 5 shows a third embodiment of the cooling fan with different guide units 570. In this embodiment, the guard blade 554 and the corresponding stationary blade 516 of each guide unit 570 are formed by cutting a single blade along an axis, resulting in the single blade being separated into two parts, i.e., the stationary blade 516 and the guard blade 554. A gap 571 is thus defined between stationary blade 516 and the guard blade 554 along the circumference of the cooling fan. A windward surface 5162 of the stationary blade 516 and a windward surface 5542 of the guard blade 554 cooperatively form a smooth convex surface, and a leeward surface 5164 of the stationary blade 516 and a leeward surface 5544 of the guard blade 554 cooperatively form a smooth concave surface.

Figure 6:
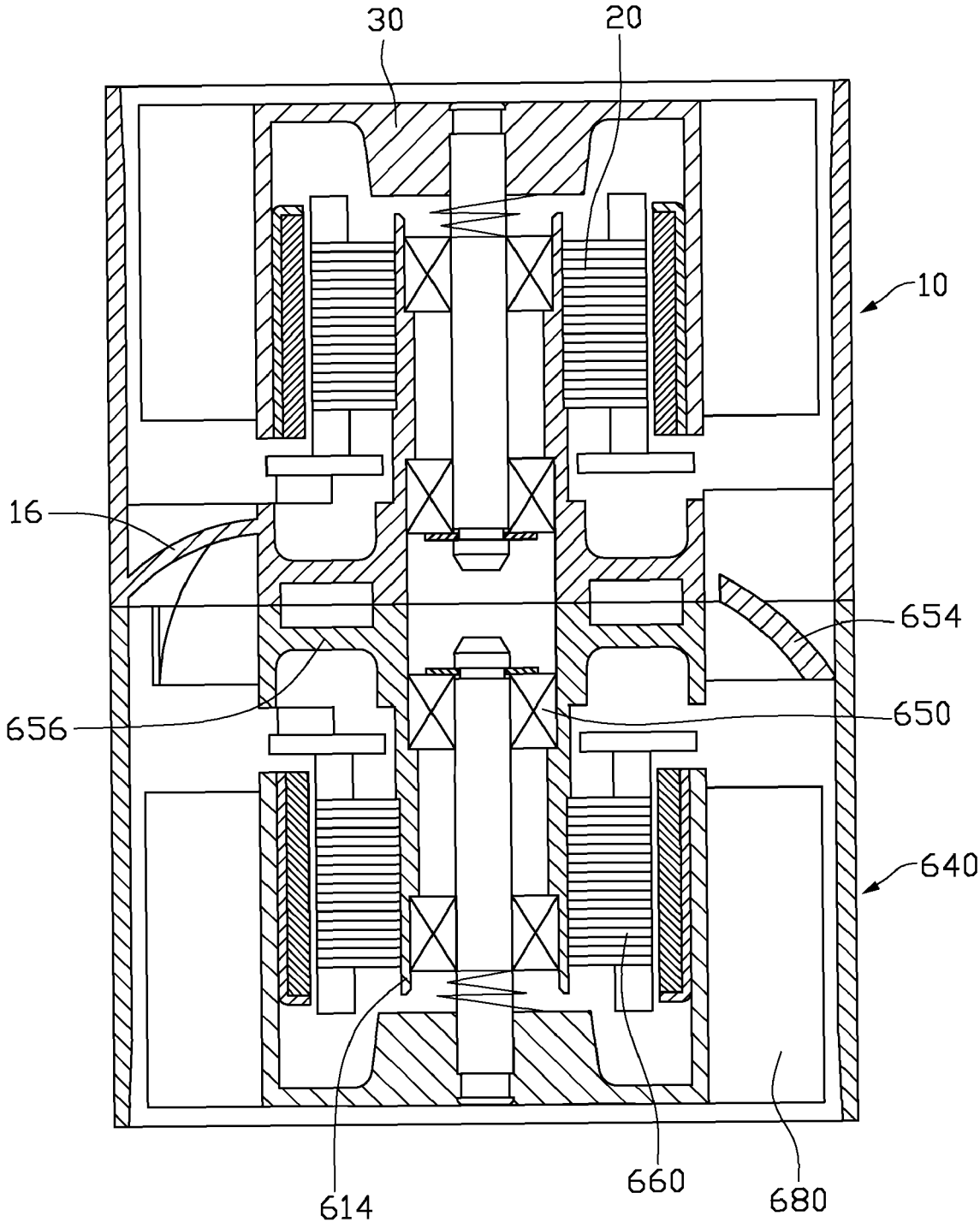
FIG. 6 is a cross section of the cooling fan according to a fourth embodiment.
Figure 7:
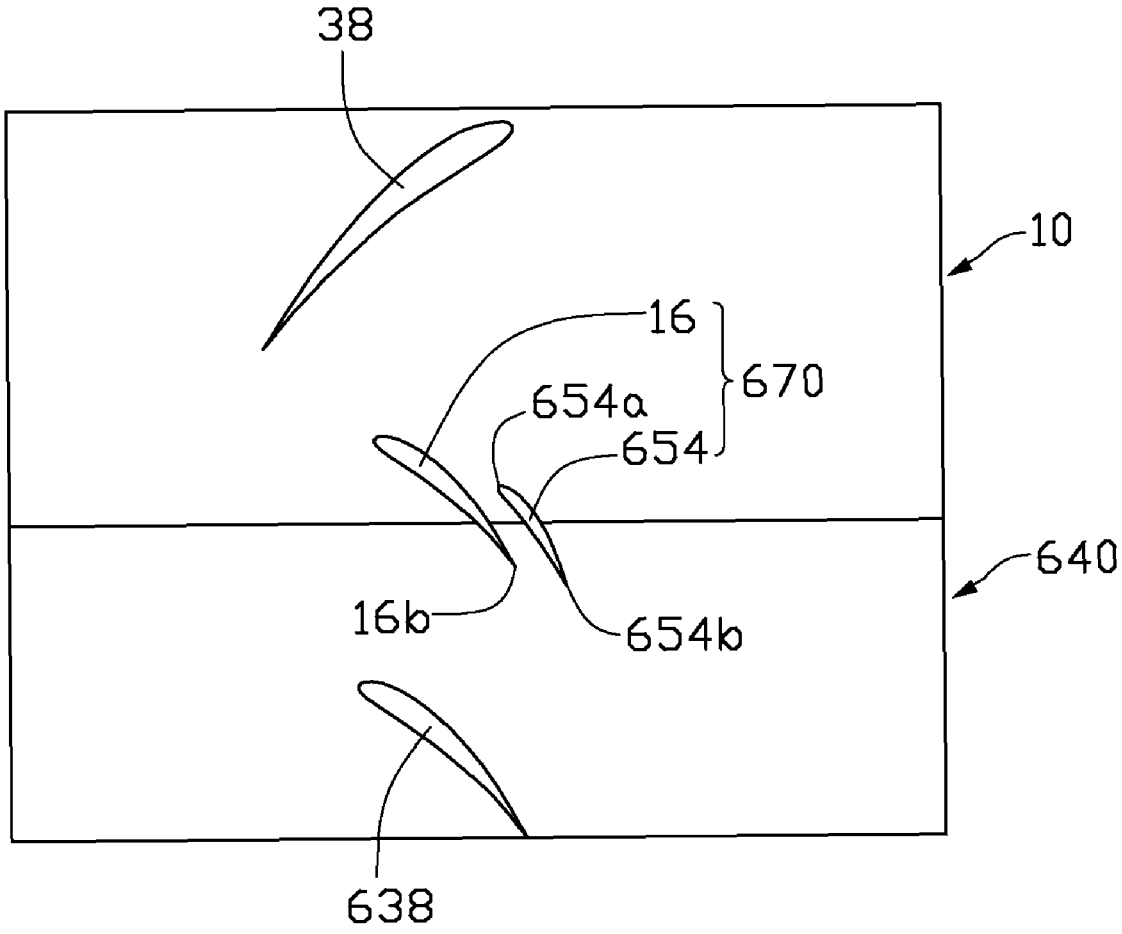
FIG. 7 shows the relationship between the rotary blades and the guide units of FIG. 6.

FIGS. 6-7 show a fourth embodiment of the cooling fan, differing from previously disclosed embodiments only in that the cylinder 656 here has a second tube 614 formed in a central portion thereof, a pair of second bearings 650 received in the second tube 614, a second stator 660 being mounted around the second tube 614 and located under the guard blades 654, and a second rotor 680 surrounding the stator 660. The second rotor 680 includes a plurality of second rotary blades 638. Thus the guide units 670 are located between the rotary blades 38, 638 of the two rotors 30, 680. A bottom end 16*b* of the stationary blade 16 is lower than a top end 654*a* of the guard blade 654, and is approximately level with the bottom side of the fan guard 50. Thus the stationary blade 16 and the guard blade 654 of each guide unit 670 partly overlap along an axis of the fan. The second tube 614 and the second stator 660 mounted in a fan housing 640 are substantially the same as the central tube 14 and the stator 20 mounted in the fan housing 10.

Figure 8:
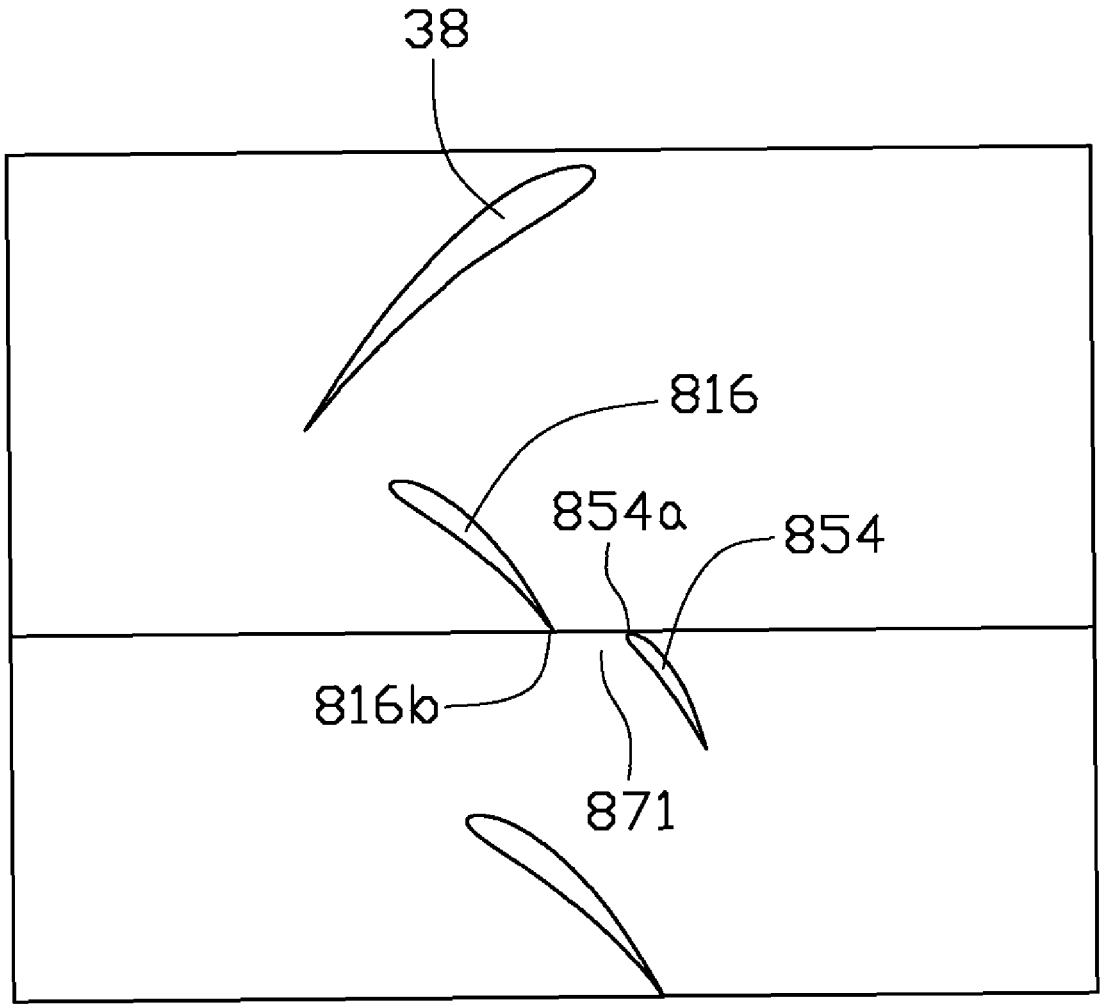
FIG. 8 shows the relationship between the rotary blades and the guide units of a fifth embodiment of the cooling fan.

FIG. 8 shows a fifth embodiment of the cooling fan similar to the fourth embodiment, differing only in that a top end 854*a* of the guard blade 854 is not higher than a bottom end 816*b* of the stationary blade 816. A gap 871 is defined between the top end 854*a* of the guard blade 854 and the bottom end 816*b* of the stationary blade 816, and thus the stationary blade 816 and the guard blade 854 are spaced along an axis of the cooling fan.

Figure 9:
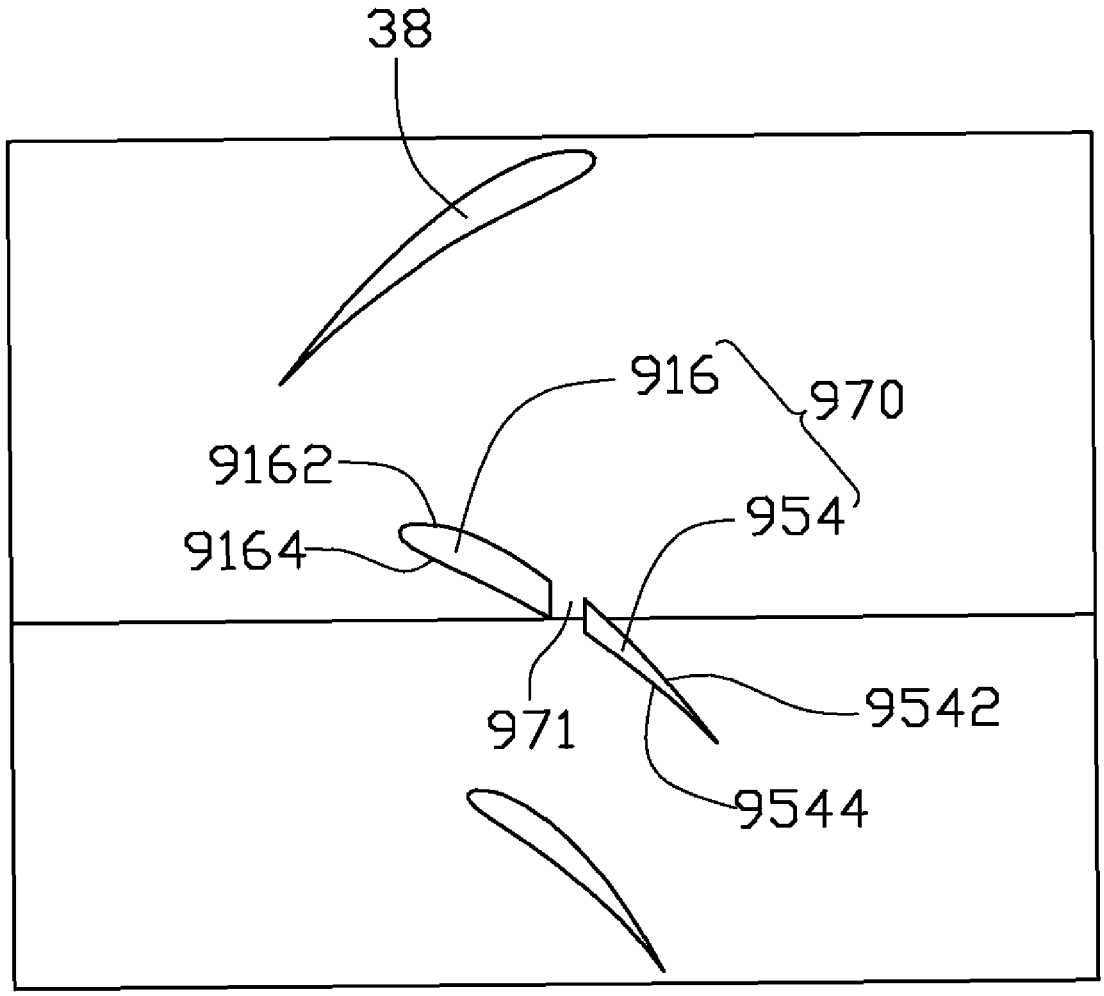
FIG. 9 shows the relationship between the rotary blades and the guide units according to a sixth embodiment of the cooling fan.

FIG. 9 shows a sixth embodiment of the cooling fan, differing only in that, here, the guard blade 954 and the corresponding stationary blade 916 of each guide unit 970 are formed by cutting a single blade along an axis, resulting in the single blade being separated into two parts, i.e., the stationary blade 916 and the guard blade 954. A gap 971 is thus defined between stationary blade 916 and the guard blade 954 along the circumference of the cooling fan. A windward surface 9162 of the stationary blade 916 and a windward surface 9542 of the guard blade 954 cooperatively form a smooth convex surface, and a leeward surface 9164 of the stationary blade 916 and a leeward surface 9544 of the guard blade 954 cooperatively form a smooth concave surface.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A cooling fan, comprising:

a fan housing defining an intake and an outlet at two opposite sides thereof, respectively;

a base received in the fan housing and arranged at the outlet of the fan housing;

a stator received in the fan housing and mounted on the base;

a rotor rotatably supported by the stator; and a plurality of guide units radially arranged at the outlet of the fan housing, each guide unit comprising a first portion and a second portion arranged under the first portion along an axis from the air intake to the outlet, the first portion and the second portion of each guide unit spaced along a circumference of the cooling fan.

2. The cooling fan of claim 1, wherein each first portion includes a windward surface and an opposite leeward surface, and the second portion of the guide unit faces the windward surface of the first portion.

3. The cooling fan of claim 1, further comprising a fan guard attached to the outlet of the fan housing, the fan guard comprising a cylinder, a second tube extending from a center of the cylinder, a second stator mounted around the second tube, and a second rotor surrounding the second stator, wherein the second portions of the guide units extend radially from the cylinder.

4. The cooling fan of claim 3, wherein the guide units are arranged between the rotor and the second rotor.

5. The cooling fan of claim 1, further comprising a fan guard attached to the outlet of the fan housing, the fan guard comprising a frame and a cylinder arranged in the frame, and wherein the second portions of the guide units extend radially from the cylinder to the frame.

6. The cooling fan of claim 5, wherein a bottom end of the first portion is lower than a top end of the second portion, and wherein the first portion and the second portion of each guide unit partly overlap along an axis of the cooling fan.

7. The cooling fan of claim 6, wherein the bottom end of the first portion is lower than a bottom side of the fan housing and extends into the fan guard.

8. The cooling fan of claim 6, wherein the top end of the second portion is higher than a top side of the fan guard and extends into the fan housing.

9. The cooling fan of claim 5, wherein a bottom end of the first portion is not lower than a top end of the second portion, and wherein the first portion and the second portion of each guide unit are spaced along an axis of the cooling fan.

10. The cooling fan of claim 9, wherein the bottom end of the first portion is substantially level with a bottom side of the fan housing, and a top end of the second portion is substantially level with a top side of the fan guard.

11. The cooling fan of claim 1, wherein the first portion and the second portion of each guide unit are formed by cutting a single blade along an axis, a windward surface of the first portion and a windward surface of the second portion cooperatively form a smooth convex surface, and a leeward surface of the first portion and a leeward surface of the second portion cooperatively form a smooth concave surface.

12. A cooling fan, comprising:

a fan housing defining an intake and an outlet at two opposite sides thereof, respectively;

a base received in the fan housing and arranged at the outlet of the fan housing;

a plurality of stationary blades extending from the base to the fan housing;

a fan guard attached to the outlet of the fan housing, the fan guard comprising a cylinder formed at a center thereof, the cylinder attached to the base, and a plurality of guard blades extending radially and outwardly from the cylinder, wherein each guard blade and the nearest stationary blade define a gap therebetween along a circumference of the cooling fan.

13. The cooling fan of claim 12, wherein each guard blade and the nearest stationary blade are spaced along an axis of the cooling fan.

14. The cooling fan of claim 12, wherein each guard blade and the nearest stationary blade partly overlap along an axis of the cooling fan.

15. The cooling fan of claim 12, wherein each guard blade and the nearest stationary blade are formed by cutting a single blade along an axis, a windward surface of the stationary blade and a windward surface of the guard blade cooperatively form a smooth convex surface, and a leeward surface of the stationary blade and a leeward surface of the guard blade cooperatively form a smooth concave surface.

* * * * *